US011159898B2

(12) United States Patent
Frei et al.

(10) Patent No.: US 11,159,898 B2
(45) Date of Patent: Oct. 26, 2021

(54) MODULE OF A HEARING DEVICE, A REMOVAL TOOL, A HEARING DEVICE AND A METHOD OF SEPARATING A MODULE FROM A HOUSING

(71) Applicant: Sonova AG, Stafa (CH)

(72) Inventors: Christian Frei, Stafa (CH); Matthias Stadler, Mannedorf (CH); Andre Lucien Ochsenbein, Wolfhausen (CH); Tobias Balmer, Hinterkappelen (CH)

(73) Assignee: SONOVA AG, Stäfa (CH)

( * ) Notice: Subject to any disclaimer, the term of this patent is extended or adjusted under 35 U.S.C. 154(b) by 0 days.

(21) Appl. No.: 16/487,917

(22) PCT Filed: Feb. 23, 2017

(86) PCT No.: PCT/EP2017/054184

§ 371 (c)(1),
(2) Date: Aug. 22, 2019

(87) PCT Pub. No.: WO2018/153456

PCT Pub. Date: Aug. 30, 2018

(65) Prior Publication Data

US 2020/0236478 A1 Jul. 23, 2020

(51) Int. Cl.
*H04R 25/00* (2006.01)

(52) U.S. Cl.
CPC ..... *H04R 25/609* (2019.05); *H04R 2225/025* (2013.01); *H04R 2460/17* (2013.01)

(58) Field of Classification Search
CPC ..... H04R 2460/17
See application file for complete search history.

(56) References Cited

U.S. PATENT DOCUMENTS 4,870,688 A * 9/1989 Voroba ..... H04R 25/609 381/60
5,347,584 A * 9/1994 Narisawa ..... H04R 25/602 381/323
6,354,990 B1 * 3/2002 Juneau ..... H04R 25/60 600/25
7,321,663 B2 1/2008 Olsen
(Continued)

FOREIGN PATENT DOCUMENTS

CN 101043761 A 9/2007
CN 105340294 A 2/2016
(Continued)

OTHER PUBLICATIONS

International Search Report for PCT/EP2017/054184 dated Nov. 2, 2017.

(Continued)

*Primary Examiner* — Angelica M McKinney
(74) *Attorney, Agent, or Firm* — Pearne & Gordon LLP

(57) ABSTRACT

A module of a hearing device is removably connectable with a housing of the hearing device, the module being prepared for insertion of a removal tool. The module includes at least two side walls opposing each other. The side walls are provided with a first engagement means, and the side walls are deformable such to allow engagement of the first engagement means and a second engagement means formed on an anchoring portion of the removal tool.

16 Claims, 11 Drawing Sheets

(56) References Cited

U.S. PATENT DOCUMENTS

| | | | | |
|---|---|---|---|---|
| 7,388,961 | B2 * | 6/2008 | Shennib | H04R 25/652 381/329 |
| 8,014,871 | B2 | 9/2011 | Dalton et al. | |
| 9,860,653 | B2 * | 1/2018 | Olsen | H04R 25/652 |
| 2003/0179895 | A1 * | 9/2003 | Doudoukjian | H04R 25/556 381/322 |
| 2004/0010181 | A1 * | 1/2004 | Feeley | H04R 25/60 600/25 |
| 2004/0258264 | A1 * | 12/2004 | Jorgensen | H04R 25/65 381/328 |
| 2007/0223767 | A1 * | 9/2007 | Jorgensen | H04R 25/00 381/380 |
| 2011/0206225 | A1 * | 8/2011 | Moller | H04R 25/556 381/314 |
| 2013/0195303 | A1 | 8/2013 | Tada | |

FOREIGN PATENT DOCUMENTS

| | | | |
|---|---|---|---|
| CN | 105409244 | A | 3/2016 |
| EP | 1 838 134 | B1 | 9/2007 |
| EP | 2963944 | A2 | 1/2016 |
| GN | 106465026 | A | 2/2017 |
| WO | 87/07465 | A1 | 12/1987 |

OTHER PUBLICATIONS

Written Opinion for PCT/EP2017/054184 dated Nov. 2, 2017.
First Office Action and Search Report for corresponding Chinese application No. 201780087296.7 dated Nov. 2, 2020.

* cited by examiner

MODULE OF A HEARING DEVICE, A REMOVAL TOOL, A HEARING DEVICE AND A METHOD OF SEPARATING A MODULE FROM A HOUSING

TECHNICAL FIELD

The present invention is related to a module of a hearing device, a removal tool, a hearing device and a method of separating a module from a housing.

BACKGROUND OF THE INVENTION

Hearing devices are typically used to improve the hearing capability or communication capability of a user. A hearing device may pick up the surrounding sound with a microphone of the hearing device, processing the microphone signal thereby taking into account the hearing preferences of the user of the hearing device and providing the processed sound signal into a hearing canal of the user via a miniature loudspeaker, commonly referred to as a receiver. A hearing device may also receive sound from an alternative input such as an induction coil or a wireless interface.

In the state of the art, hearing devices are known which comprise a faceplate equipped with mechanical and electrical components of the hearing device. Said faceplate can be connected to the housing of the hearing device by means of mechanical parts comprising springs, pins, etc. However, the mechanical parts that need to be removed in order to separate the faceplate from the housing are space consuming. Further, operations which are necessary to separate the faceplate from the housing are time consuming and incur high costs. Document U.S. Pat. No. 7,321,663 B2 describes mounting a socket part into a battery opening by means of resilient lugs which engage into grooves. Handles are provided in order to allow the socket part to be grasped.

It is an object of the present invention to provide a module of a hearing device which solves the problems known in the prior art. In particular, an object of the present invention is to provide a module which is compact, small-sized and allows to be separated from the hearing device housing in a reliable way. It is further object of the present invention to provide a removal tool, a hearing device and a method of separating a module from a housing.

SUMMARY OF THE INVENTION

The present invention is directed to a module of a hearing device, wherein said module is removably connectable with a housing of the hearing device, said module being prepared for insertion of a removal tool, wherein said module comprises at least two side walls opposing each other, said side walls are provided with a first engagement means, and said side walls are deformable such to allow engagement of the first engagement means and a second engagement means formed on an anchoring portion of the removal tool. Hence, the present invention provides a module which can be reliably separated from the housing without the need of additionally mechanical parts. Therefore, provided is a module which is compact in size and which additionally allows to be separated from the housing in a reliable and non-destructive way. Further, complexity is reduced.

In an embodiment, the module is openable to one end such to allow insertion of the removal tool. In an example, the module can be opened to one end by simply opening a battery door and removing the battery. Additionally, the battery door can be removed, as well. The opened end of the module allows to simply insert the removal tool for separating the module from the housing.

In an embodiment of the proposed module the first engagement means comprises at least one opening or recess or protrusion formed at the inner surface of the side walls. The openings formed to the inner surface of the side walls can be engaged with protrusions of the removal tool once the side walls of the module are deformed.

In a further embodiment of the proposed module the second engagement means comprises at least one protrusion or opening or recess being prepared to engage with the at least one first engagement means. The protrusions which protrude from the periphery of the anchoring portion can penetrate through the openings once the side walls of the module are deformed. Once the protrusions penetrate through the openings, said protrusions and openings are engaged or rather abut against each other. Said engagement condition allows to separate the module from the housing by simply pulling out the engaged module by means of the removal tool. In case of the first engagement means is formed as a recess, the protrusion of the anchoring portion is allowed to abut against the recess such to simply achieve engagement when pulling out the module. In an example, the first engagement means can comprise at least one protrusion protruding from the side wall while the second engagement means can comprise at least one opening and/or recess formed into the anchoring portion of the removal tool. In this example, the protrusions protruding from the side walls can penetrate the openings formed into the anchoring portion of the removal tool once the side walls of the module are deformed. As soon as the protrusions and openings are engaged, the module can be separated from the housing by simply pulling out the engaged module by means of the removal tool.

In an embodiment of the proposed module the side walls comprise a metal sheet. The metal sheet can be deformed by clamping the side walls of the module in a direction to each other such to achieve the above-mentioned engagement. In an example, even if the clamping force is released, this deformation can be maintained. In another example, if the clamping force is released, the metal sheets resume its former shape. Advantageously, the metal sheets additionally strengthen the side walls such to improve the integrity of the module.

In an embodiment of the proposed module the side walls are configured to be inwardly deformed when applying forces to outer surfaces thereof in directions to each other, and wherein the first and second engagement means are adapted to be engaged during an inward deformation of the side walls and to be disengaged when the side walls are not inwardly deformed. This embodiment allows proper engagement of the first and second engagement means by simply applying forces to outer surfaces of the side wall, wherein said forces are applied in directions to each other, i.e. inwardly in relation to the module. The feature of disengagement between the first and second engagement means when the side walls are not inwardly deformed allows to proper release the module from the removal tool once the module is separated from the housing. Further, proper reuse of the module can be achieved.

In an embodiment, the module is removably connectable with the housing by means of a click mechanism formed at the outer surface of the side walls, said click mechanism being prepared to connect the module to the housing upon pushing the module into an opening of the housing, and to release the connection with the housing upon inward deformation of the side walls. The click mechanism can be adapted to allow separation of the module from the housing once a pull-out force, which is applied to the module in relation to the housing, exceeds a predetermined separation-threshold. Additionally, or as an option, the click mechanism can be released by deforming outer surfaces of the module in directions to each other such to deform thereof. While deforming the outer surfaces of the module, at least portions of the hearing device housing can be released from respective recesses which are formed into the outer surfaces of the module. Therefore, the module can be pulled out easily without further intervention. The click mechanism can allow a secure stay of the module in the hearing device housing. Further, said click mechanism can compensate possibly printing tolerances of the hearing device housing.

In an embodiment, the module is removably connectable with the housing by means of an adhesive bond, said adhesive bond being prepared to break or weaken upon inward deformation of the side walls. The adhesive bond can achieve a weak adhesion, i.e. apply a weak bonding force, which can be desired. The weak adhesive bond can be configured to reliably secure the module to the housing while additionally allow to release the module from the housing once outer surfaces of the module are deformed, e.g. to the inside, such to break, weak or rather release the adhesive bond.

In an embodiment, the module comprises a deformable base-part and a substantially non-deformable sub-module, wherein the base-part and sub-module are connected together by a snap mechanism or an adhesive bonding, wherein the base-part provides at least one of: an electrical connection between the sub-module and the base-part, and a sound inlet path between the sub-module and a sound entry. The sub-module can comprise components such as at least one microphone, processor, switch, etc. The base-part may provide for electrical connections of the sub-module to other components of the module such as battery contacts to provide power to the sub-module. The base-part may further provide for an acoustical connection between the sub-module and the ambient environment. Such a sound inlet path or rather acoustical path allows for example placing the sub-module comprising the microphone of the hearing device at a lower end of the base-part in order to save space and to build a module with a smaller diameter thus allowing to design a more compact hearing device. The module may comprise a sealing between the sub-module and the base-part and/or the base-part and the inner volume of the housing. The sealing can reduce the risk of acoustical feedback due to sound leakage. The sealing can further prevent dirt from entering into the hearing device, it may also have a mechanically stabilizing effect, thus securing the mounting position of a sub-module to the base-part and/or the base-part to the housing. Advantageously, the repair of the module can be simplified. In an example, a defective component, such as the microphone, can be replaced just by replacing the sub-module. The sub-module can be connected to the base-part by a snap-in mechanism. The sub-module could be mounted from the inside of the base-part, for example through the battery compartment, thus allowing a substitution of the sub-module without removing the base-part from the housing. Since the module could be detached from the housing in an easy way, the sub-module could also be mounted from the outer side of the base-part. It is also possible to connect the sub-module by gluing it to the base-part. The glue can be selected such to create a relatively weak adhesive bond between the base-part and the sub-module thus allowing a non-destructive separation. While such a module could be used in hearing devices comprising a faceplate, it is particularly beneficial in custom made hearing devices where the housing comprises a shell made of metal, in particular titanium.

Moreover, the present invention is directed to a removal tool adapted to separate a module according to the claims from a housing of a hearing device.

In an embodiment, the removal tool comprises an anchoring portion adapted to be inserted into the module via an opened end thereof. In an example, the battery door of the module can be opened or removed such to achieve the module presents the opened end which in turn allows insertion of the anchoring portion of the removal tool.

In an embodiment of the proposed removal tool the anchoring portion is provided with at least one second engagement means adapted to engage at least one first engagement means comprised by the module.

In an embodiment of the proposed removal tool the second engagement means comprises a protrusion or an opening or a recess. The first and second engagement means can be engaged by e.g. letting the protrusion to protrude into the opening or recess.

In an embodiment, the proposed removal tool further comprises a pair of lateral wings adapted to engage at least a portion of outer surfaces of side walls comprised by the module.

In an embodiment of the proposed removal tool the lateral wings are adapted to inwardly deform the side walls of the module once clamped together.

In an embodiment of the proposed removal tool the lateral wings are pivotably hinged to the anchoring portion.

In an embodiment of the proposed removal tool the lateral wings and the anchoring portion are formed integrally.

Moreover, the present invention is directed to a hearing device comprising a housing and a module according to the claims.

In an embodiment of the hearing device the module is separable from the housing by means of a removal tool according to the claims.

Moreover, the present invention is directed to a method of separating a module from a housing of a hearing device. The method comprises the steps of introducing an anchoring portion of a removal tool into the module via an opened end thereof, bringing first engagement means of side walls of the module into engagement with second engagement means of the anchoring portion, and pulling the module out of the hearing device housing by means of pulling the engaged removal tool in relation to the hearing device.

In an embodiment of the proposed method the step of bringing the first engagement means of the side walls of the module into engagement with the second engagement means of the anchoring portion comprises the steps of bringing lateral wings of the removal tool into engagement with at least a portion of outer surfaces of the module, and applying clamping forces to the lateral wings in relation to each other thereby deforming the outer surfaces of the module, in particular the side walls.

It is expressly pointed out that any combination of the above-mentioned embodiments is subject of further possible embodiments. Only those embodiments are excluded that would result in a contradiction.

BRIEF DESCRIPTION OF THE DRAWINGS

The present invention is further described with reference to the accompanying drawings jointly illustrating various exemplary embodiments which are to be considered in connection with the following detailed description. What is shown in the figures is.

DETAILED DESCRIPTION OF THE INVENTION

Figure 1:
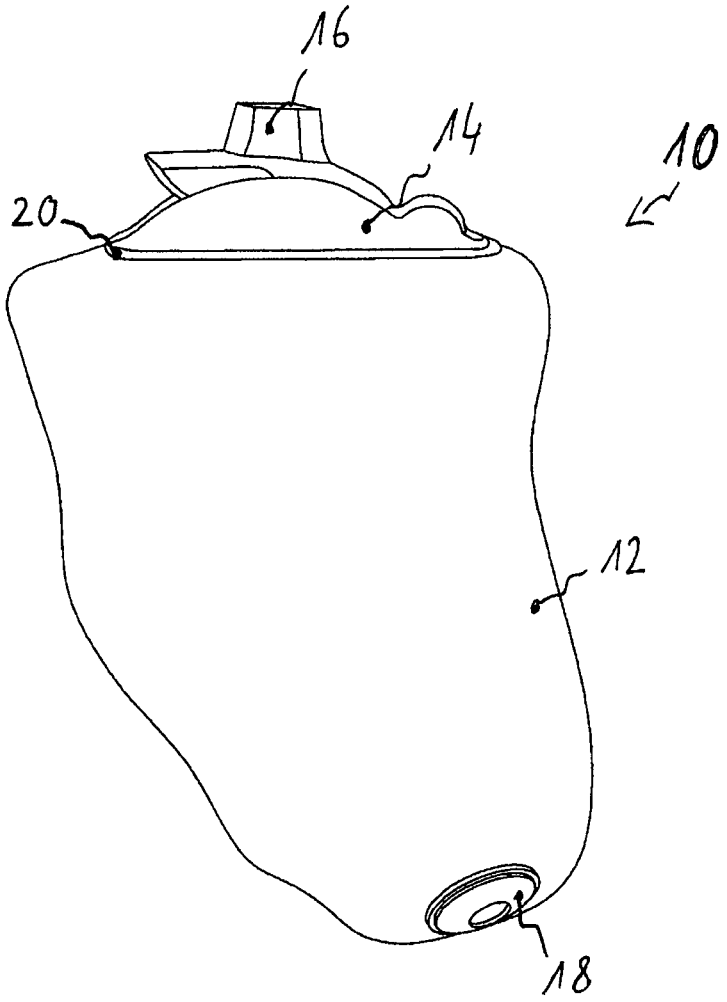
FIG. 1 is a perspective view of a hearing device comprising a module received into a housing.
Figure 2:
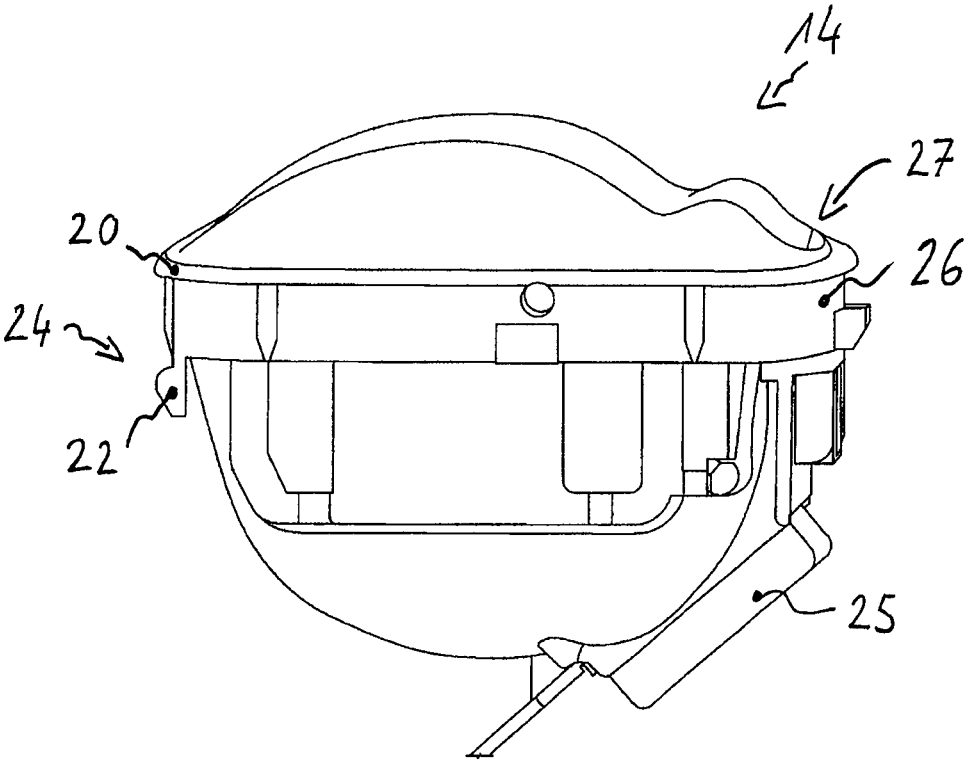
FIG. 2 depicts the module as shown in FIG. 1 in a lateral view.

FIG. 1 shows a hearing device 10 comprising a housing 12 and a module 14 inserted into the housing 12 via an opening thereof, while FIG. 2 shows the single module 14 in a side-view. The module 14 can comprise a battery compartment for receiving a battery (not shown) via a battery door 16. FIG. 1 shows the battery door 16 being closed, while FIG. 2 shows the battery door removed. The battery door 16 can be opened to exchange a used battery as well as for service, maintenance, etc. Further, as will be described in more detail in the following, the battery door 16 can be opened in order to allow separation and removal of the module 14 from the hearing device housing 12. The module 14 can further comprise a microphone, processing means, as well as further electronic and mechanical components. The hearing device 10 further comprises a sound outlet 18 for outputting sound from a receiver (not shown) of the hearing device 10 to the ear canal of the user. The housing 12 can be made of titanium.

As mentioned above, FIG. 2 shows the module 14 in a side-view. In the shown example, the module 14 is removed from the hearing device housing (refer to FIG. 1). The module 14 comprises an outer rim 20 which abuts against the periphery of an opening of the hearing device housing once inserted. The module 14 comprises an elastic latching portion 22 which forms part of a click mechanism 24. This click mechanism 24 is adapted to removably connect the module 14 to the housing. While connected, the latching portion 22 is engaged with a portion of the housing. This engagement can be released once a pull-out force applied between the module 14 and the housing in relation to each other exceeds a predetermined separation-threshold. The module 14 comprises a microphone 25 for picking up the surrounding sound and converting the sound into electrical signals. Additionally, or as an option, the module 14 can be connected to the housing by means of applying adhesive to a periphery 26 of the module 14 in a portion beneath the rim 20, which periphery 26 faces an inner rim of the housing once inserted. The module 14 further comprises a sound entry 27 of a sound inlet path (not shown but to be described in the following) for connecting the microphone 25 with the ambient thus allowing to transmit the surrounding sound to the microphone 25.

Figure 3:
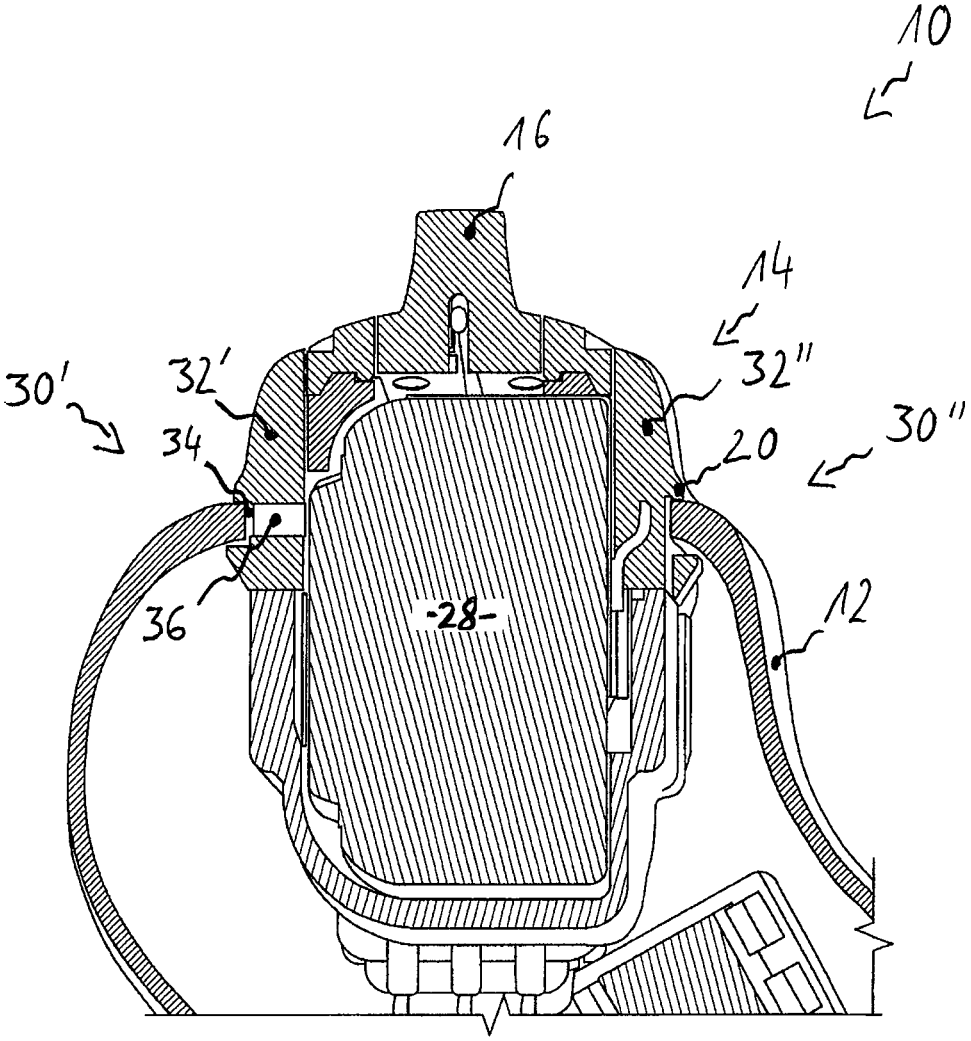
FIG. 3 is a cross-sectional view of the module and a portion of the housing of the hearing device, wherein the module is received into the housing, FIG. 4 schematically depicts a removal tool.

FIG. 3 shows the module 14 being inserted into the housing 12 in a cross-sectional view. A battery 28 is received into the module 14, while the module 14 is closed by its battery door 16. The module 14 comprises two side walls 30',30" opposing each other, wherein said side walls 30',30" each comprise outer surfaces 32',32". At least portions of said outer surfaces 32',32" are exposed to the outside. Further, portions of said outer surfaces 32',32" are engaged with the opening of the housing 12. As exemplary depicted in the figure, at least portions of the outer surfaces 32',32" comprise recesses or rather grooves which receive the inner rim of the opening formed into the housing 12. As will be discussed in more detail in the following, said engagement can be released by means of deflecting the outer surfaces 32',32" inwardly.

Additionally, or as an option, the module 14 and the housing 12 can be connected to each other by means of an adhesive which can be filled from inside the module 14 into a space 34 created between the housing 12 and the module 14. The adhesive can be filled into the space 34 via a port 36. Of course, clamping the module 14 and/or filling the adhesive into the space 34 via the port 36 can be conducted with the battery 28 removed. Further, it might be necessary to remove the battery door 16.

Figure 4:
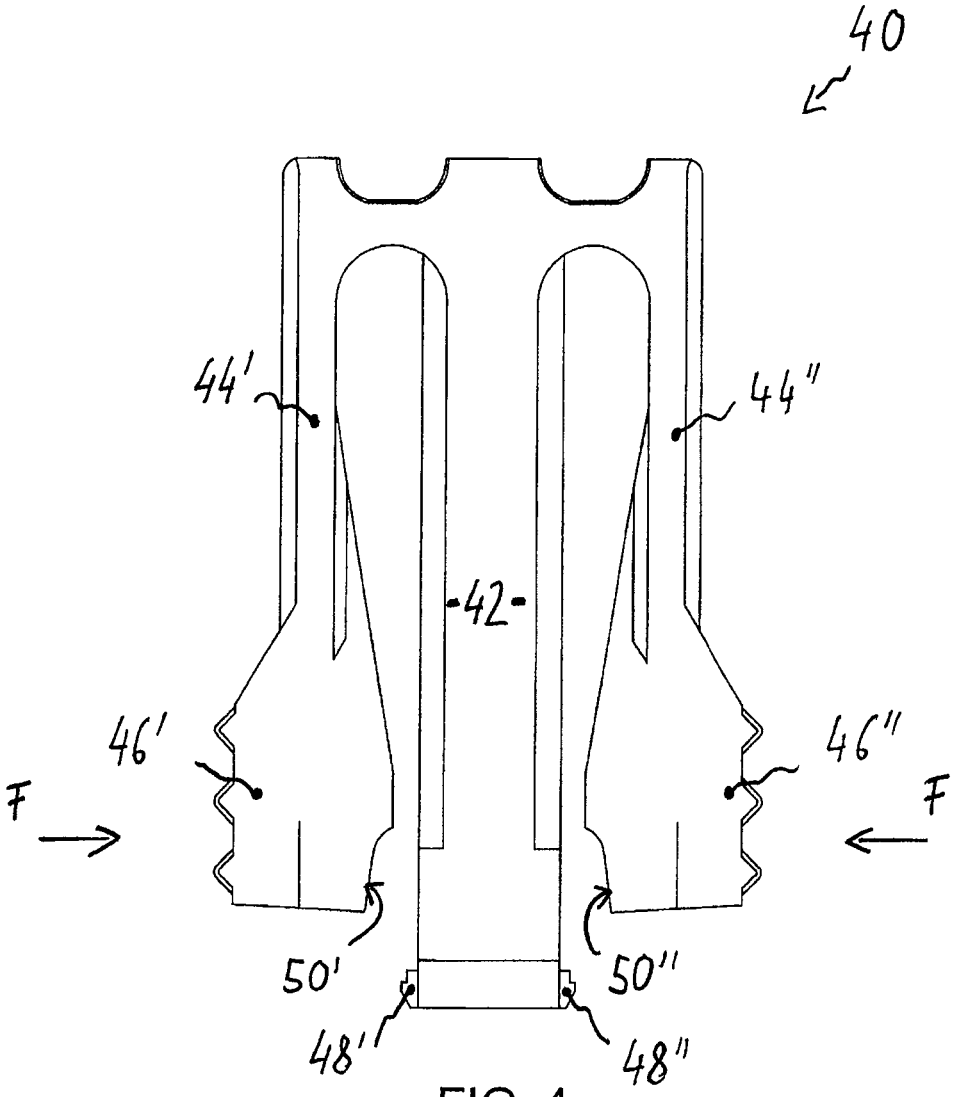

FIG. 4 shows a removal tool 40 adapted to separate the module 14 from the housing 12 (refer to FIG. 3). The removal tool 40 comprises an anchoring portion 42 and a pair of lateral wings 44',44" pivotably hinged to the anchoring portion 42. The anchoring portion 42 and the lateral wings 44',44" can be formed integrally. The lateral wings 44',44" can be displaced inwardly by applying forces to (outer) grip portions 46',46" as schematically indicated by two arrows referenced with F.

The material of the removal tool 40 can be chosen such to allow elasticity. Therefore, the lateral wings 44',44" can easily return to the shown initial state once application of the forces F to the grip portions 46',46" is terminated. While not shown, the lateral wings 44',44" can comprise components which are formed separately from the anchoring portion 42. In this example, the lateral wings 44',44" can be connected to the anchoring portion 42 by means of hinges or rather joints. In this example the lateral wings 44',44" can be connected to the anchoring portion 42 resiliently, for example by means of a spring which is respectively placed in an interposed location.

As mentioned above, the anchoring portion 42 can be inserted into the opened module 14 (refer to FIG. 3). The periphery of the distal end of the anchoring portion 42 is provided with a pair of protrusions 48',48", located on surfaces of the anchoring portion 42 opposing each other. Respective portions of the lateral wings 44',44" which oppose each other can be formed with rests 50',50" which are formed such to rest against outer surfaces of the module once the removal tool 40 is seated onto the module. Further details relating to the protrusions 48',48" and rests 50',50" will be described in the following.

Figure 5:
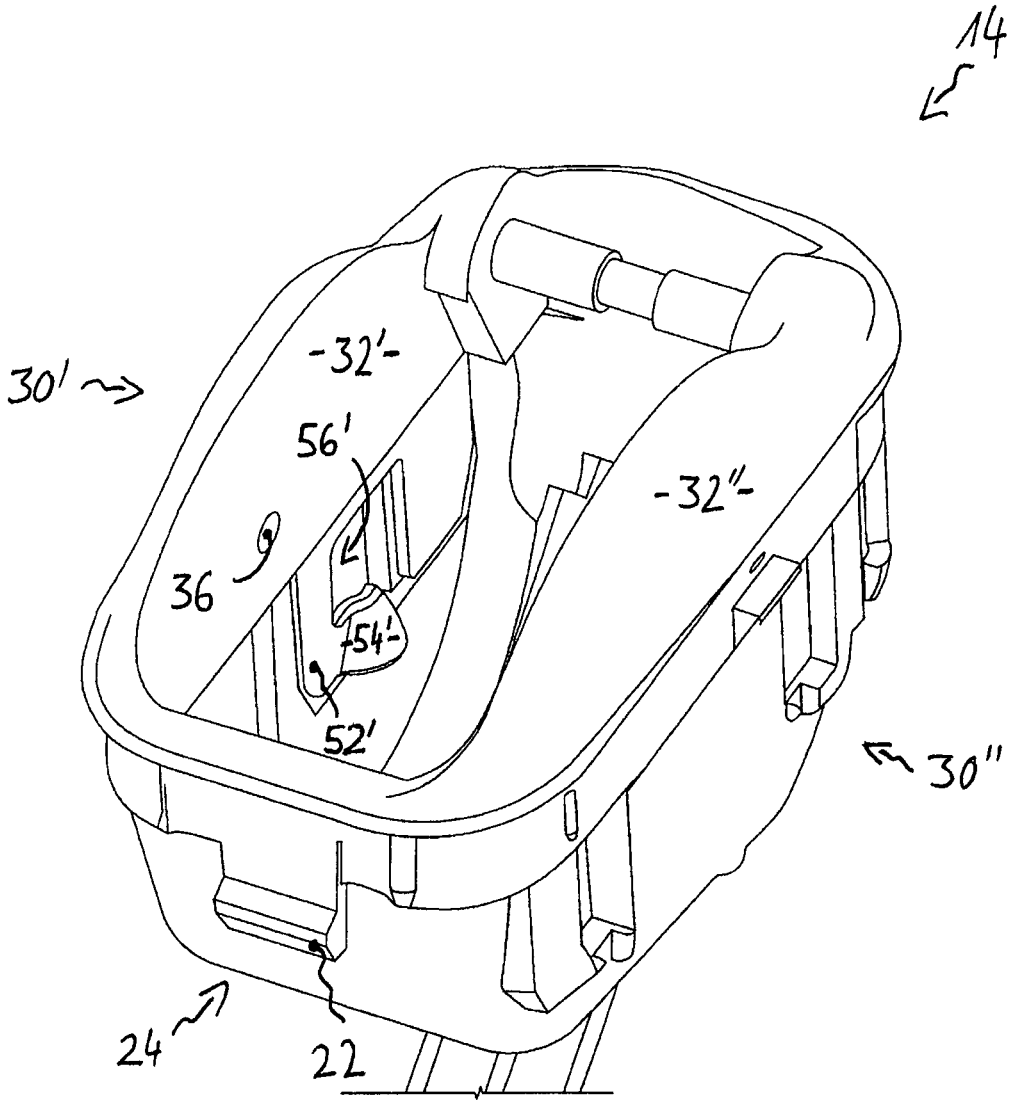
FIG. 5 is a perspective view of the module with its battery door removed, FIG. 6 schematically depicts the removal tool as well as the module in a condition in which the removal tool can be inserted into the opened module.

FIG. 5 shows the module 14 as e.g. shown in FIG. 2 in a perspective view. This view allows to show the interior of the module 14 via its opened end. In order to avoid redundancy, description of features which have already been described in the above (e.g. relating to FIG. 2) will be omitted. As mentioned above, the side walls 30',30" comprise outer surfaces 32',32", respectively. The side walls 30',30" can further comprise deformable metal sheets broadly designated with 52'. The metal sheet 52' can comprise a battery pin 54' allowing electrical connection with a battery (not shown) once inserted. Further details to the metal sheet 52' will be provided in the following.

Figure 6:
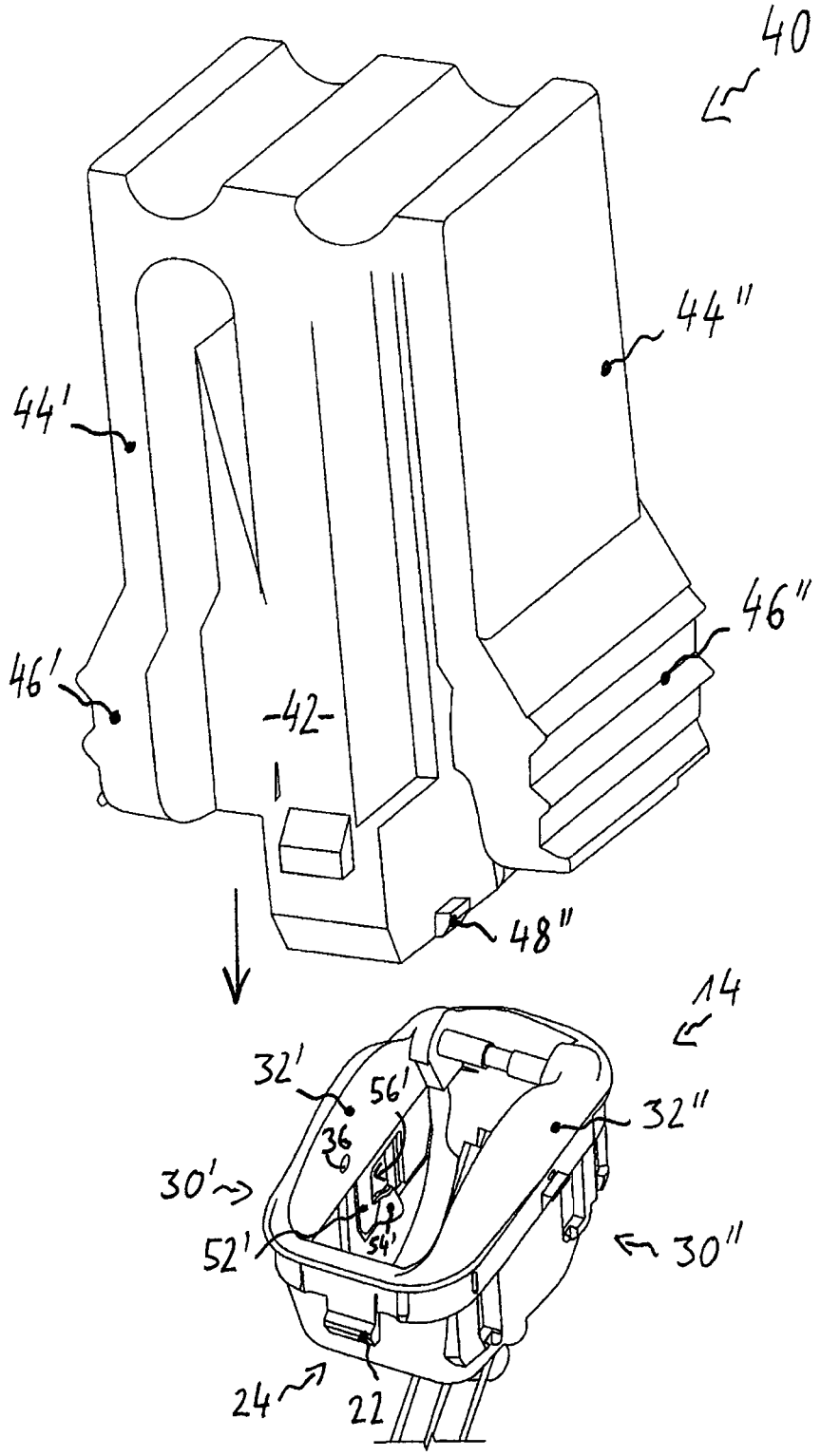

FIG. 6 schematically shows the module 14 and the removal tool 40 as depicted in e.g. FIGS. 4 and 5. The module 14 is prepared for insertion of the anchoring portion 42 of the removal tool 40 as schematically depicted by means of an arrow.

Figure 7A:
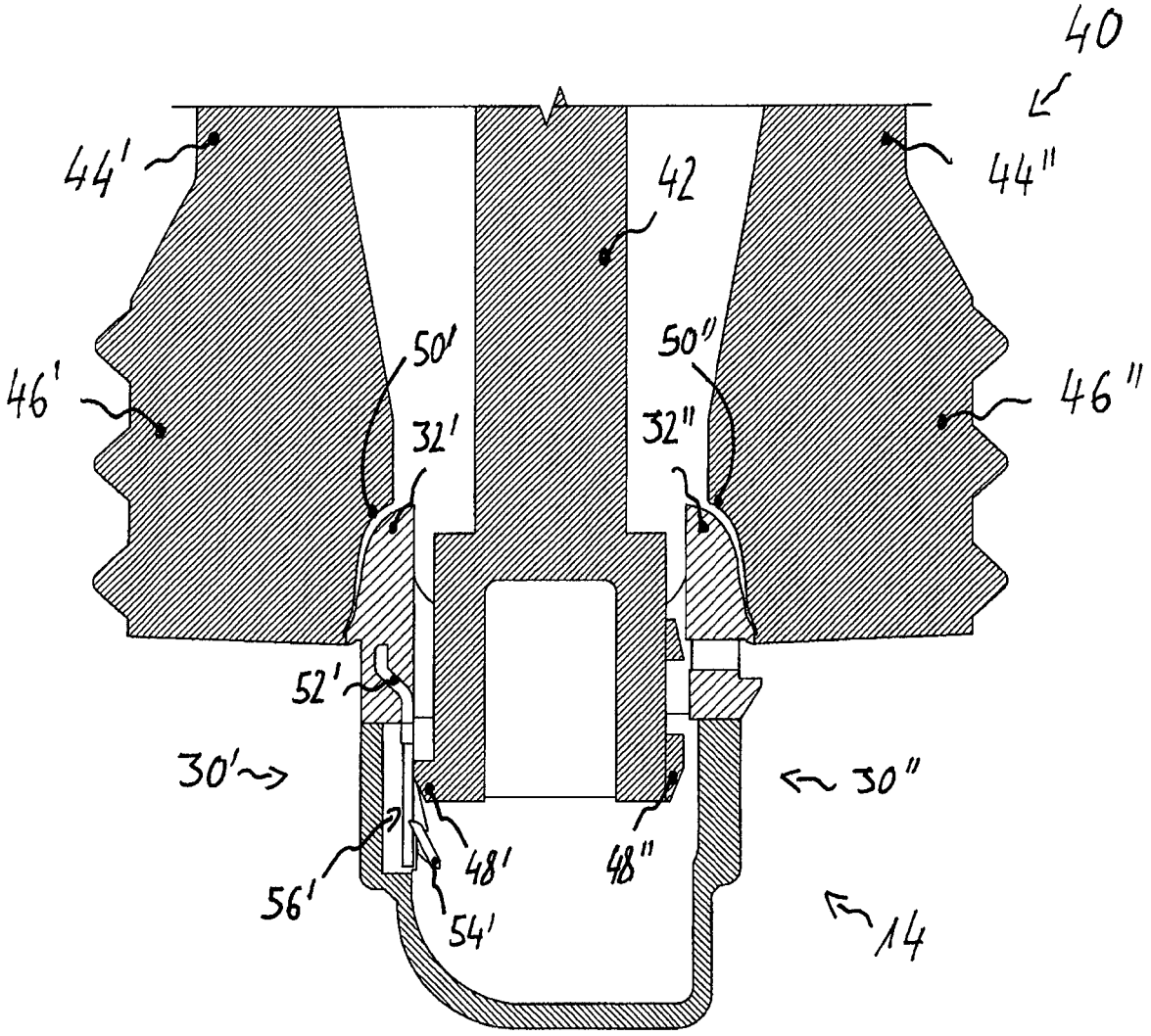
FIG. 7A is a cross-sectional view depicting an anchoring portion of the removal tool inserted into the module while lateral wings of the removal tool engage outer surfaces of side walls of the module.
Figure 7B:
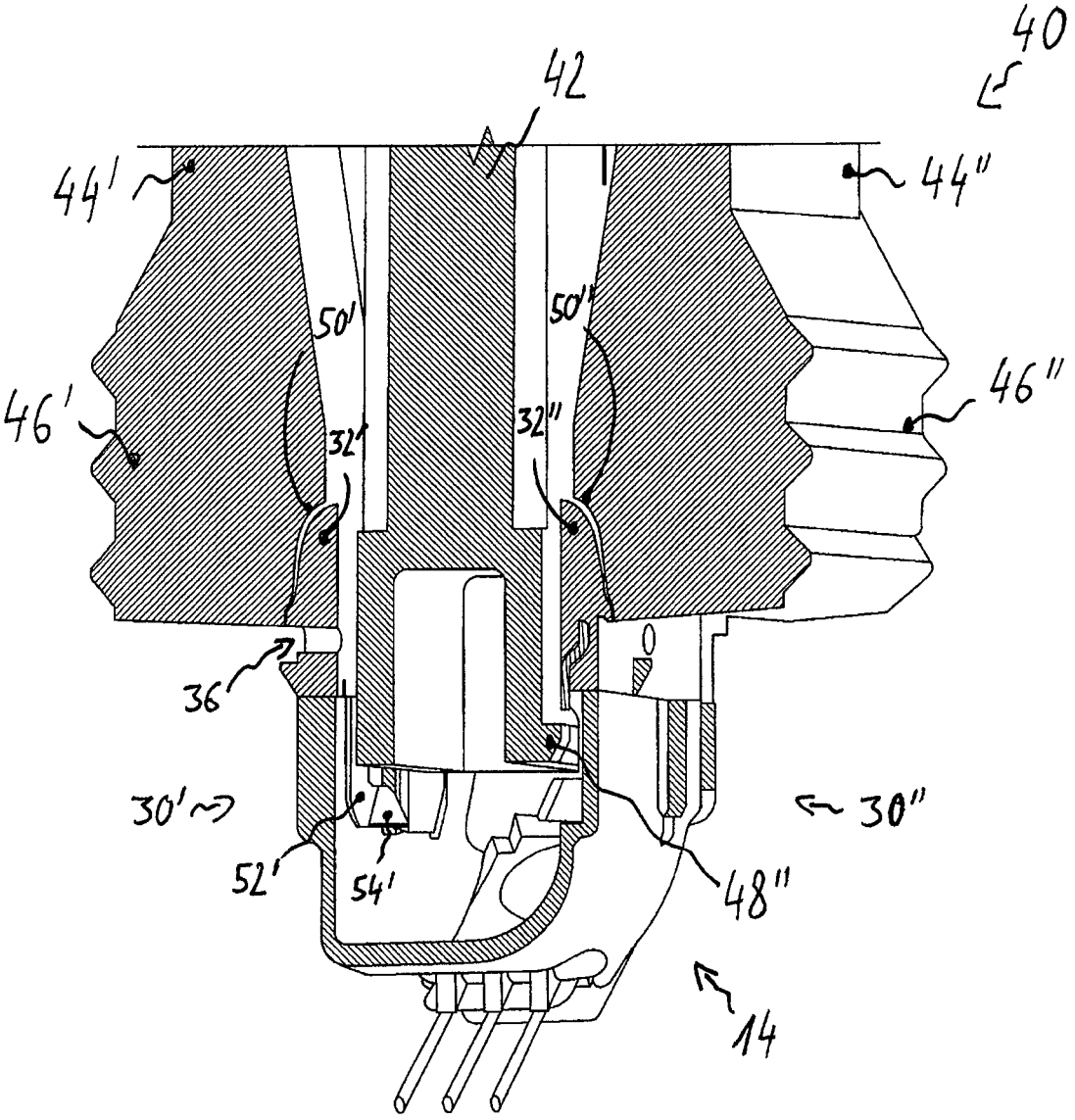
FIG. 7B is a perspective view of the illustration as depicted in FIG. 7A.

FIGS. 7A,7B are cross-sectional views showing in different viewing angles the anchoring portion 42 inserted into the module 14 via its opened end. Once inserted, the rests 50',50" of the lateral wings 44',44" rest against the outer surfaces 32',32" of the side walls 30',30". The interior of the module 14 is dimensioned such that the anchoring portion 42 is located with its protrusions 48',48" facing respective openings 56',56" which are formed in respective portions of the side walls 30',30". The respective portions of the side walls 30',30" which are provided with said openings 56',56" can be deformable metal sheets broadly designated with 52',52".

Figure 8A:
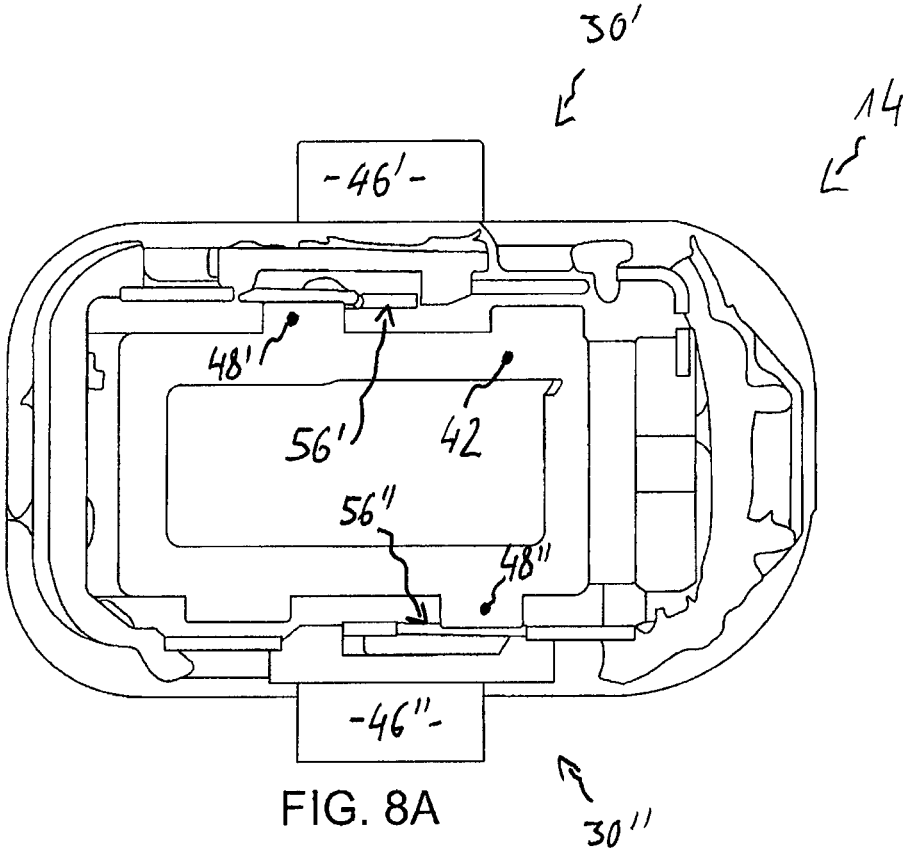
FIG. 8A is a bottom view depicting the anchoring portion inserted into the module while the side walls of the module are not deformed.

FIGS. 8A,B show bottom views of the module 14 while also showing the distal end of the anchoring portion 42 inserted into the module 14, respectively. In both figures, blocks broadly referenced with 46',46" schematically depicts the grip portions of the lateral wings 44',44" as can be best seen in FIGS. 7A,B.

Figure 8B:
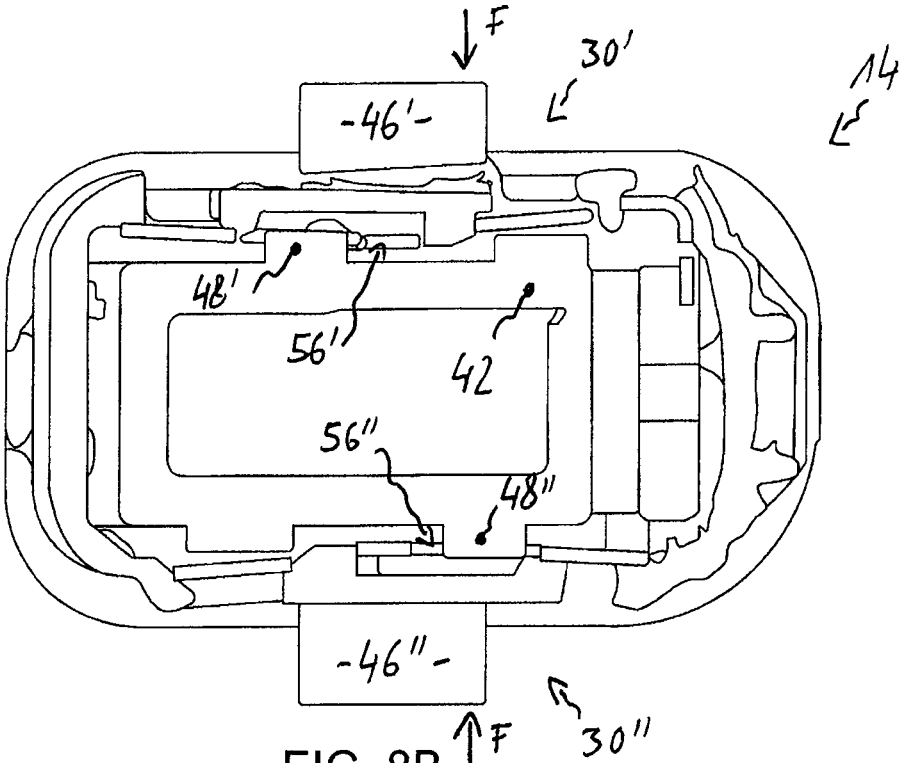
FIG. 8B is the bottom view as shown in FIG. 8A, wherein the side walls of the module are deformed.

FIG. 8A shows a state in which no forces are applied to the grip portions 46',46" of the lateral wings 44',44", while FIG. 8B shows a state in which forces F are applied to the grip portions 46',46" and thus to the outer surfaces 32',32" of the module 14. Said forces F are directed to each other or rather inwardly, as indicated by F arrows. In doing so, as can be seen in FIG. 8B, the side walls 30',30" are deformed such that the protrusions 48',48" of the anchoring portion 42 protrude into the openings 56',56" formed into the side wall 30',30" such to engage with each other. In other words, the deformation of the side walls 30',30" allows that the protrusions 48',48" engage the side walls 30',30". This results in that the protrusions 48',48" abut against portions of the side walls 30',30" while trying to pull out the anchoring portion 42 of the removal tool 40 in a direction out of the module 14. To put it in other words, the module 14 is caught by the removal tool 40. As soon as the module 14 is caught by the removal tool 40, the module 14 can be separated from the housing 12 by simply applying a pull-out force in relation to each other, which pull-out force needs to exceed a separation-threshold.

Figure 9:
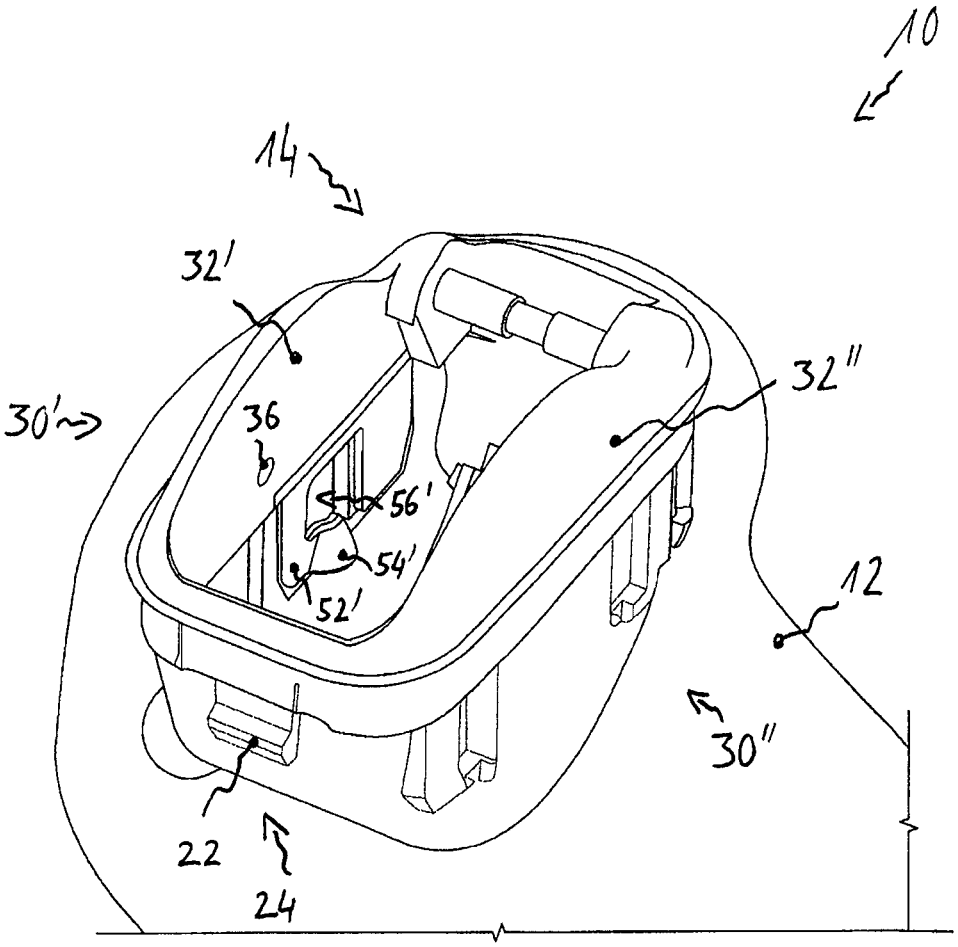
FIG. 9 is a semi-transparent view showing the module inserted into the housing of the hearing device, and FIG. 10 schematically depicts a cross sectional view of the module 14 comprising a sub-module and a base-part.

In other words, as can be best seen in FIG. 9, a connection provided by the click mechanism 24 needs to be released, which can be achieved by proper pulling the module 14 engaged with the removal tool out of the housing 12. Therefore, a non-destructive removal of the module 14 can be achieved, especially for cases like service, maintenance, etc. Hence, the module 14 can be reused after removal. The click mechanism 24 allows a secure stay of the module 14 in the housing 12 as well as to compensate possible printing tolerances while manufacturing of the housing 12 (e.g. 3D printing). Additionally, or as an option to the click mechanism 24, the module 14 can be connected to the housing 12 by means of an adhesive applied to an inner space created between the periphery 26 of the module 14 and the inner rim of the opening of the housing 12, which opening 12 is for inserting the module 14 into the housing 12. As mentioned above, the module 14 comprising the deformable side walls 30',30" can be inserted into the rigid housing 12 and removed therefrom in a non-destructive manner.

Figure 10:
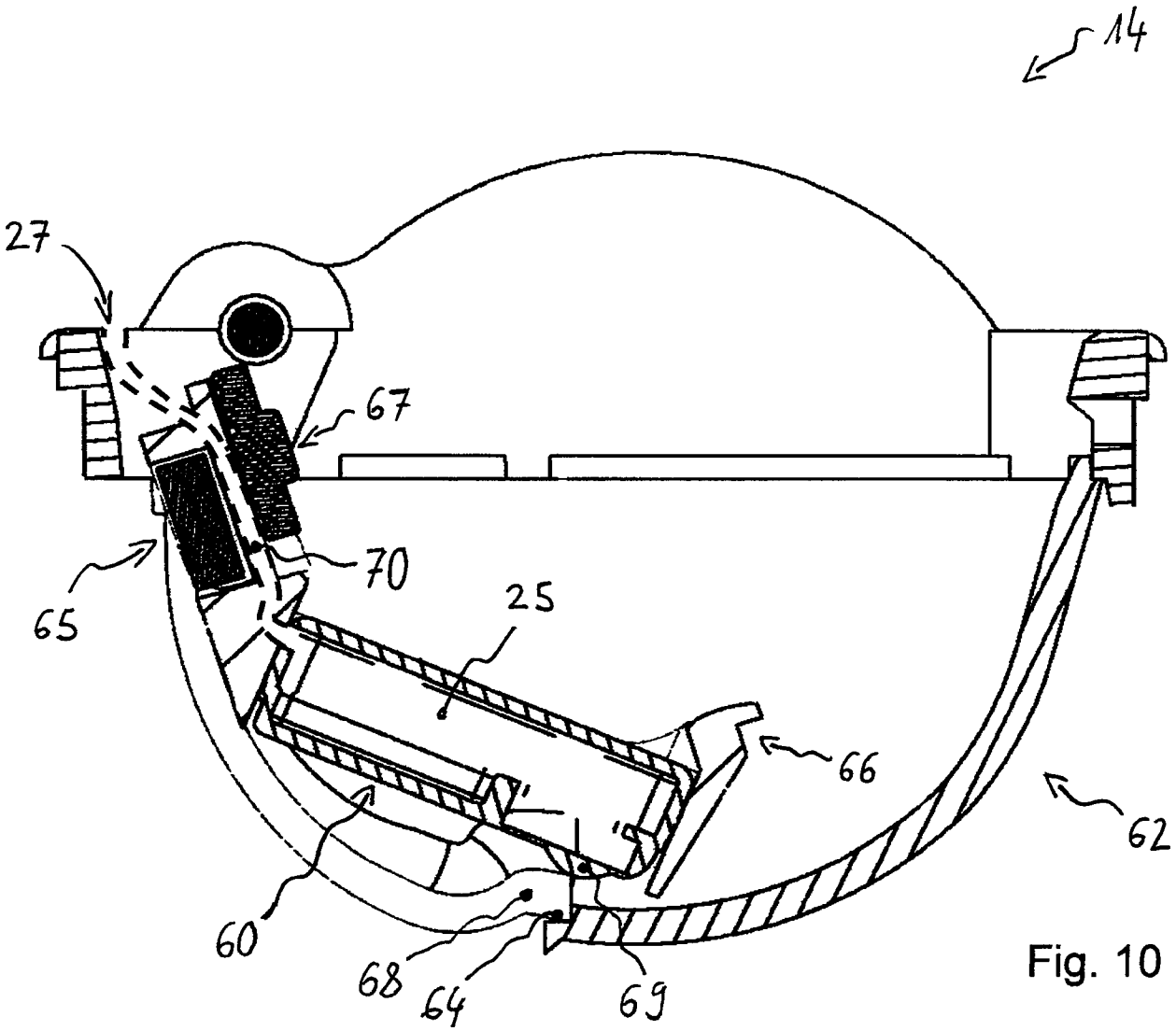

FIG. 10 schematically depicts a cross sectional view of the module 14. The shown module 14 comprises a sub-module 60 and a base-part 62 which can be removably connected to each other. In particular, FIG. 10 shows the sub-module 60 while it is inserted or removed from the base-part 62.

The sub-module 60 is substantially non-deformable because it can contain delicate components such as the microphone 25, as well as e.g. processors and switches (both not shown). On the other hand, the base-part 62 is deformable such to elastically maintain the sub-module 60 in place by means of a snap-in mechanism. In particular, the snap-in mechanism comprises a recess 64 and a latch 66. The recess 64 is formed into the base-part 62 for (elastically) receiving the latch 66 formed to the sub-module 60. The sub-module 60 and/or the base-part 62 can further comprise a Giant-Magnetic-Resistor (GMR) 65 and/or a switch 67.

The base-part 62 may provide for electrical connections of the sub-module 60 to other components of the module 14. The base-part 62 can comprise an electrical contact 68 and the sub-module can comprise a contact 69 for contacting e.g. a battery once inserted for supplying power to the sub-module 60. The module 14 can further comprise an acoustical path or rather sound inlet path 70 between the sound entry 27 (and thus the ambient) and the microphone 25 of the sub-module 60. The sound inlet path 70 allows for example placing the sub-module 60 comprising the microphone 25 at a lower end of the base-part 62 in order to save space and to build a module 14 with a smaller diameter thus allowing to design a more compact hearing device. Hence, the base-part 62 provides an electrical connection between the sub-module 60 and the base-part 62, and/or a sound inlet path 70 between the sub-module 60 and the sound entry 27.

In the shown example, the sub-module 60 is connected to the base-part 62 by means of the snap-in mechanism as described above. In addition or as an option, the module 14 can comprise a sealing between the sub-module 60 and the base-part 62 and/or the base-part 62 and the inner volume of the housing of the hearing device (both not shown). The sealing can reduce the risk of acoustical feedback due to sound leakage. The sealing can further prevent dirt from entering the hearing device 10. The sealing may also have a mechanically stabilizing effect, thus securing the mounting position of the sub-module 60 to the base-part 62 and/or the base-part 62 to the housing.

In an aspect of the invention, the repair of the module 14 can be simplified. If a component, such as the microphone 25, is defective, the detective component can be replaced just by replacing only the sub-module 60. In particular, FIG. 10 shows how to disconnect the sub-module 60 from the base-part 62 by simply releasing or rather unlatching the snap-in mechanism.

FIG. 10 shows the module 14 with the battery removed from the battery compartment. This allows the sub-module 60 to be accessible from the outside or rather from the opened end of the module 14 through the battery compartment. In this state, the sub-module 60 can be removed from the base-part 62 by just releasing or rather unlatching the snap-in mechanism. Hence, the sub-module 60 is removable through the battery compartment of the module 14 thus allowing to e.g. substitute the sub-module 60 without the necessity to remove the base-part 62 from the housing.

As mentioned above, the module 14 can be detached from the housing in an easy way. Therefore, in a non-shown example, the sub-module 60 can also be attached to or detached from the base-part 62 via the outer side of the base-part 62 once the module 14 is separated from the housing 12. It is also possible to connect the sub-module 60 by gluing it to the base-part 62. The glue can be carefully selected such to create a relatively weak adhesive bond between the base-part 62 and the sub-module 60 thus allowing a non-destructive separation. The shown module 14 is particularly beneficial in custom made hearing devices comprising housings made of metal, in particular titanium.

What is claimed is:

1. A module (14) of a hearing device (10), wherein said module (14) is removably connectable with a housing (12) of the hearing device (10), said module (14) being prepared for insertion of a removal tool (40), wherein said module (14) comprises at least two side walls (30',30") with inner surfaces opposing each other, said inner surfaces of said side walls (30',30") are provided with a first engagement means (56',56") comprising at least one opening or recess or protrusion formed at the inner surface of the side walls (30'30"), and said side walls (30',30") are deformable such to allow engagement of the first engagement means (56',56") and a second engagement means (48',48") formed on an anchoring portion (42) of the removal tool (40), wherein a pair of lateral wings (44',44") of the removal tool are pivotably hinged to the anchoring portion (42), the second engagement means comprising at least one protrusion or opening or recess configured to engage with the at least one first engagement means (56',56"), wherein the side walls (30',30") of the module (14) are inwardly deformable by the lateral wings (44',44") of the removal tool engaging respective outer surfaces of the side walls when the lateral wings are clamped together.

2. The module (14) according to claim 1, wherein the module (14) is openable to one end such to allow insertion of the removal tool (40).

3. The module (14) according to claim 1, wherein the side walls (30',30") comprise a metal sheet (52',52").

4. The module (14) according to claim 1, wherein the side walls (30',30") are configured to be inwardly deformed when applying forces to outer surfaces (32',32") thereof in directions to each other and wherein the first (56',56") and second (48',48") engagement means are adapted to be engaged during an inward deformation of the side walls (30',30") and to be disengaged when the side walls (30',30") are not inwardly deformed.

5. The module (14) according to claim 4, wherein the module (14) is removably connectable with the housing (12) by means of a click mechanism (24) formed at the outer surface (32',32") of the side walls (30',30"), said click mechanism (24) being prepared to connect the module (14) to the housing (12) upon pushing the module (14) into an opening of the housing (12) and to release the connection with the housing (12) upon inward deformation of the side walls (30',30").

6. The module (14) according to claim 4, wherein the module (14) is removably connectable with the housing (12) by means of an adhesive bond, said adhesive bond being prepared to break or weaken upon inward deformation of the side walls (30',30").

7. The module (14) according to claim 1, wherein the module (14) comprises a deformable base-part (62) and a non-deformable sub-module (60), wherein the base-part (62) and sub-module (60) are connected together by a snap-in mechanism or an adhesive bonding, wherein the base-part (62) provides at least one of:

an electrical connection between the sub-module (60) and the base-part (62), a sound inlet path (70) between the sub-module (60) and a sound entry (27).

8. The removal tool (40) according to claim 1, wherein the lateral wings (44',44") and the anchoring portion (42) are formed integrally.

9. The hearing device (10) comprising the housing (12) and the module (14) according to claim 1.

10. The hearing device (10) according to claim 9, wherein the module (14) is separable from the housing (12) by means of the removal tool (40) adapted to separate the module (14) from the housing (12).

11. The module according to claim 1, wherein inward deformation of the side walls by the lateral wings causes the first engagement means (56', 56") to engage with the second engagement means (30', 30").

12. A removal tool (40) for a hearing device (10), wherein said removal tool (40) is adapted to separate a module (14) from a housing (12) of the hearing device (10), wherein said module (14) is removably connectable with the housing (12) of the hearing device (10), said module (14) is prepared for insertion of the removal tool (40), and said module (14) comprises at least two deformable side walls (30',30") with inner surfaces opposing each other, the removal tool comprising an anchoring portion (42); a second engagement means (48',48") formed on the anchoring portion and comprising at least one protrusion or opening or recess configured to engage with a first engagement means (56',56") comprising at least one opening or recess or protrusion formed on each of said inner surfaces of said deformable side walls (30',30"); wherein a pair of lateral wings (44',44") of the removal tool are pivotably hinged to the anchoring portion (42) and adapted to engage at least a portion of outer surfaces (32',32") of the side walls (30',30") and inwardly deform the sidewalls when the lateral wings are clamped together.

13. The removal tool (40) according to claim 12, wherein the anchoring portion (42) is adapted to be inserted into the module (14) via an opened end thereof.

14. The removal tool of claim 12, wherein inward deformation of the side walls by the lateral wings causes the first engagement means (56', 56") to engage with the second engagement means (30', 30").

15. A method of separating a module (14) from a housing (12) of a hearing device (10), said method comprising the steps of introducing an anchoring portion (42) of a removal tool (40) into the module (14) via an opened end thereof, bringing first engagement means (56',56") comprising at least one opening or recess or protrusion formed at an inner surface of side walls (30',30") of the module (14) into engagement with second engagement means (48', 48") of the anchoring portion (42), a pair of lateral wings (44',44") of the removal tool are pivotably hinged to the anchoring portion (42), the second engagement means comprising at least one protrusion or opening or recess configured to engage with the at least one first engagement means (56,56"), and bringing the lateral wings (44,44") of the removal tool (40) into engagement with at least a portion of outer surfaces (32'32") of the module (14), applying clamping forces to the lateral wings (44',44") in relation to each other thereby inwardly deforming the outer surfaces (32'32") of the module (14), and pulling the module (14) out of the hearing device housing (12) by means of pulling the engaged removal tool (40) in relation to the hearing device (10).

16. The method according to claim 15, wherein the inwardly deforming the outer surfaces of the module causes the first engagement means (56', 56") to engage with the second engagement means (30', 30").

* * * * *